US006478590B1

(12) United States Patent
Kuo

(10) Patent No.: US 6,478,590 B1
(45) Date of Patent: Nov. 12, 2002

(54) EJECTION MECHANISM FOR COMPACT FLASH CARD CONNECTOR

(75) Inventor: Ming-Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/036,077

(22) Filed: Dec. 24, 2001

(51) Int. Cl.[7] ..... H01R 13/62
(52) U.S. Cl. ..... 439/159
(58) Field of Search ..... 439/159, 160

(56) References Cited

U.S. PATENT DOCUMENTS 5,149,276 A * 9/1992 Dixon ..... 439/152
5,899,763 A * 5/1999 Kajiura ..... 439/159
5,997,325 A * 12/1999 Hara ..... 439/159
6,059,588 A * 5/2000 Tung et al. ..... 439/159
6,074,227 A * 6/2000 Ho et al. ..... 439/159
6,109,941 A * 8/2000 Koseki et al. ..... 439/159
6,139,339 A * 10/2000 Wu ..... 439/159
6,210,187 B1 * 4/2001 Tung ..... 439/159
6,319,028 B1 * 11/2001 Zhang et al. ..... 439/159

* cited by examiner

*Primary Examiner*—Gary Paumen
(74) *Attorney, Agent, or Firm*—Wei Te Chung

(57) ABSTRACT

An ejection mechanism for a compact flash connector (1) comprising an insulative header (2) having a pair of guiding arms (22) connected by a cross bar (20), a lever (31) pivotally mounted on the cross bar, a coil spring (32), and a push button (33) movably assembled to one of the arms. The arm has a receiving slot (226) comprising a T-shape front portion **(226*a*) and a rear portion (226*b*) for receiving the coil spring (32) therein. The push button has a front portion (330) connected with the lever and a rear T-shape block (3320)** movably retained in the T-shape front portion of the received slot. The push button actuates the lever by pushing T-shape block frontwardly.

1 Claim, 3 Drawing Sheets

EJECTION MECHANISM FOR COMPACT FLASH CARD CONNECTOR

BACKGROUND OF THE INVENTION

1. Field of the Invention

The present invention relates to the art of electrical connectors, more particularly to an ejection mechanism for a compact flash card connector.

2. Description of the Related Art

Compact flash card connectors have become popular in applications such as digital cameras and portable computers. The card connectors are commonly configured with an ejection mechanism mounted on a frame thereof and driven by a push button thereof to disconnect and eject compact flash cards therefrom. U.S. Pat. Nos. 6,139,339 and 5,149,276 disclose ejection mechanisms for the compact flash card connectors. However, such ejection mechanisms were either easy to destroy and difficult to repair, or too thick in dimension as not to be suitable for slim space applications. Improvements of the ejection mechanism for the card connectors are therefore desirable.

SUMMARY OF THE INVENTION

Accordingly, an object of the present invention is to provide a compact flash card connector having a stable and simple ejection mechanism.

To achieve the above object, an ejection mechanism for a compact flash card connector in accordance with the present invention comprises an insulative header having a cross bar and a pair of guiding arms integrally extending from opposite ends of the cross bar. At least one of the guiding arms forms a receiving slot at an outer side thereof, the receiving slot has a front portion and a rear portion connected with the front portion thereby forming a sidestep therebetween. A lever is pivotally mounted on the cross bar with an ejection portion defined at one end thereof. A spring is located in the rear portion of the receiving slot and positioned by the sidestep. A push button is movably retained on one of the arms. The push button comprises a front portion connected with the lever and a rear portion connected with the front portion, the rear portion has a locating block retained in the T-shaped front portion of the receiving slot, the locating block is rearwardly urged by the spring and is frontwardly movable to actuate the lever.

Other objects, advantages and novelty features of the invention will become more apparent from the following detailed description when taken in conjunction with the accompanying drawings.

DESCRIPTION OF THE PREFERRED EMBODIMENT

Figure 1:
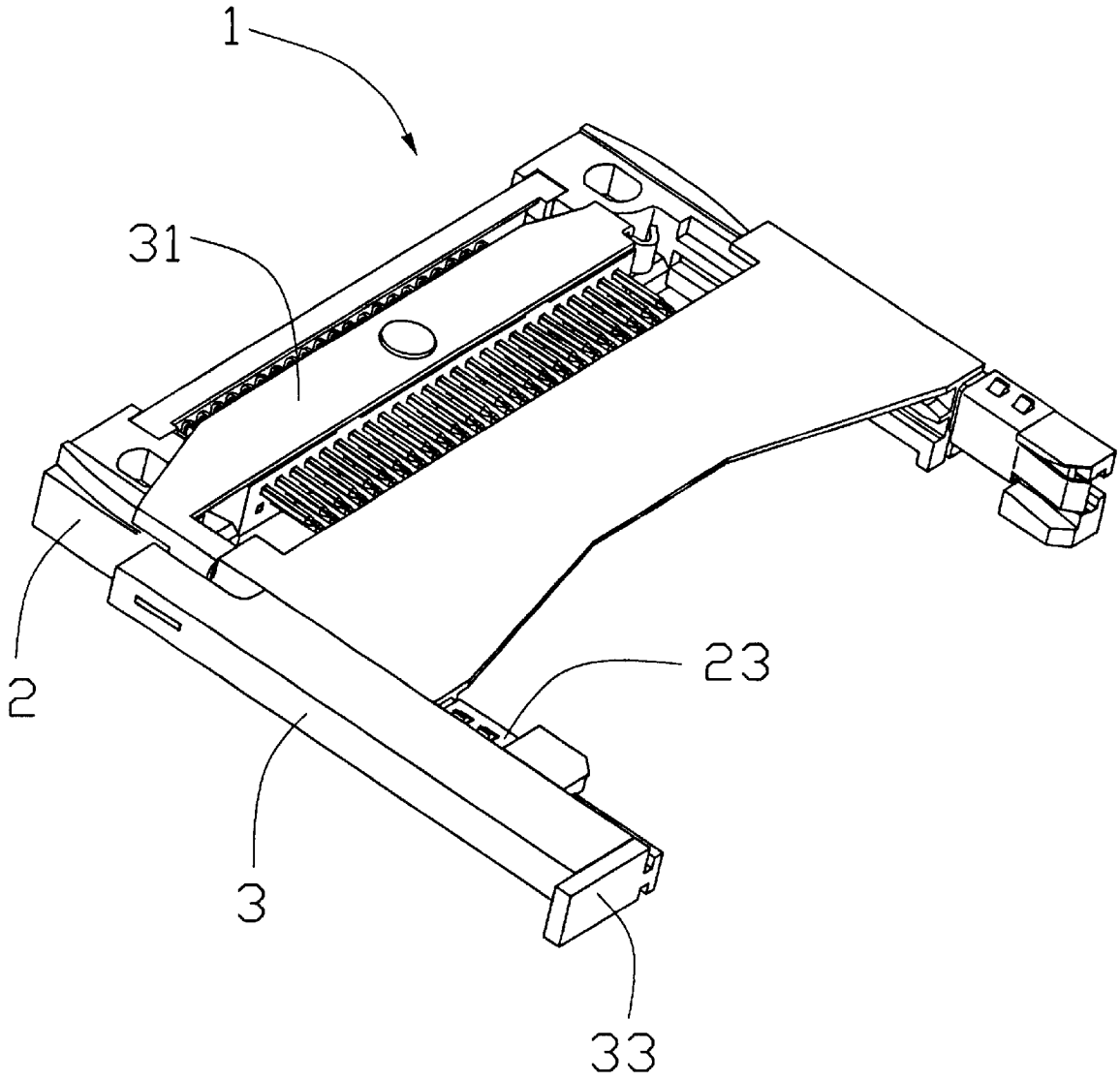
FIG. 1 is a perspective view of a compact flash card connector in accordance with a preferred embodiment of the present invention.

Reference will now be made to the drawing figures to describe the present invention in detail.

Referring to FIG. 1, a compact flash card connector 1 in accordance with the present invention comprises an insulative header 2 and an ejection mechanism 3 assembled to the header 2.

Figure 2:
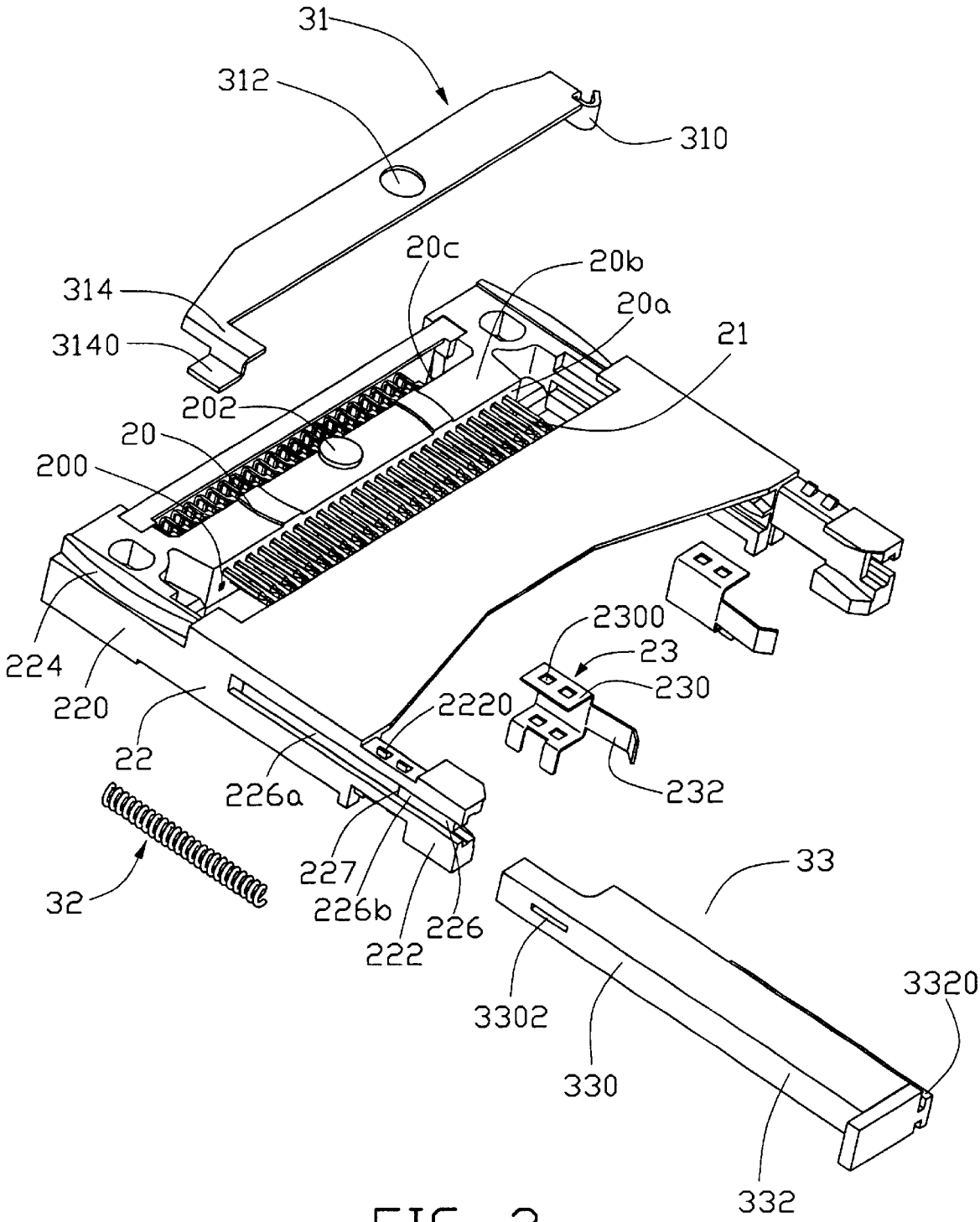
FIG. 2 is an exploded view of FIG. 1.
Figure 3:
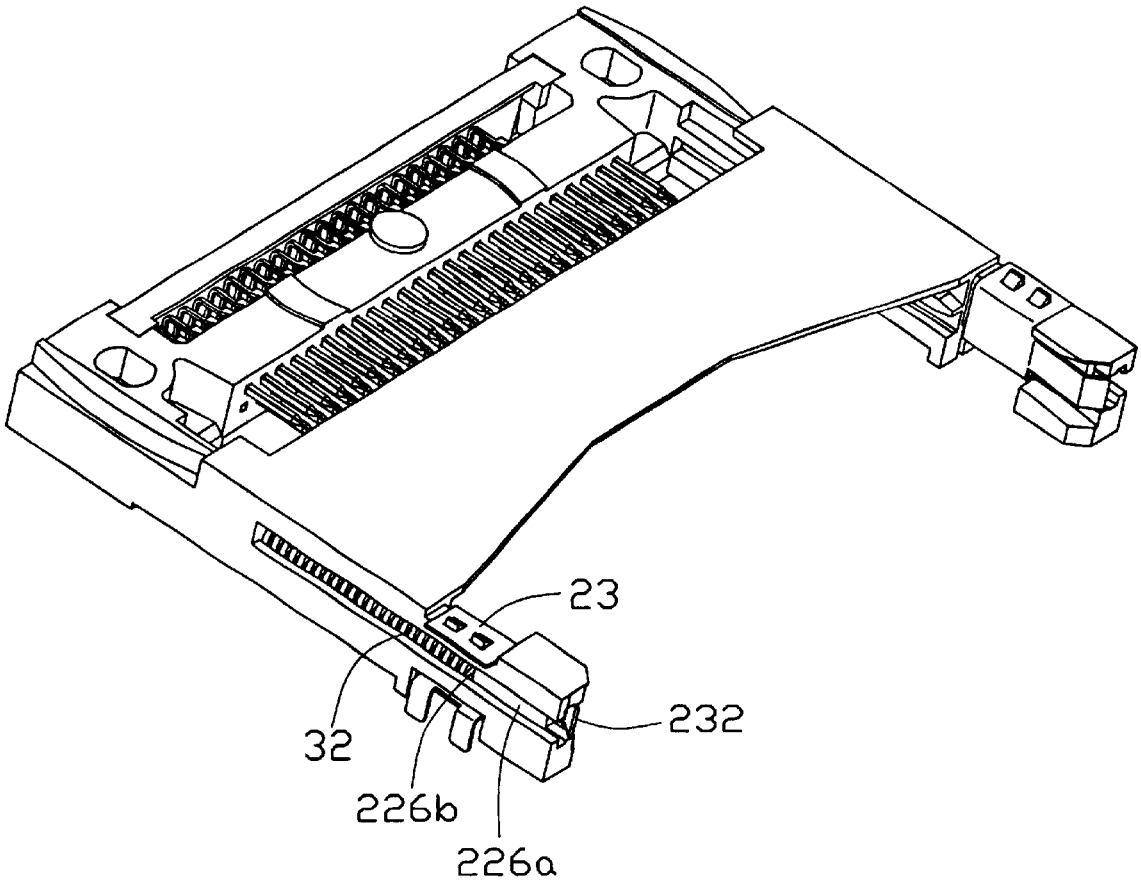
FIG. 3 is a perspective view of an insulative header of the compact flash card connector of FIG. 1, assembled with a coil spring.

Referring to FIG. 2, the header 2 comprises a cross bar 20 and a pair of guiding arms 22 extending out from opposite ends of the cross bar 20. The cross bar 20 has a mating face 20*a*, a top face 20*b* and a rear face 20*c* opposite to the mating face 20*a*. Two rows of passageways 200 are defined between the mating and rear faces 20*a*, 20*c* with a plurality of signal contacts 21 assembled therein. A shaft 202 is projected at a middle of the mating face 20*b*. Each guiding arm 22 comprises a rear portion 220 connecting with the middle bar 20 and a front portion 222 extending out from the rear portion 220. A sliding recess 224 is concaved at the rear portion 220, and a locating slot 226 is defined at an outer side of the front portion 222. The locating slot 226 comprises a deeper rear portion 226*a* and a shallower front portion 226*b* connected with the rear portion 226*a* thereby forming a sidestep 227 therebetween. The front portion 226*a* presents a T-shape figuration. A pair of metallic buckles 23 is respectively secured to the front portions 222 of the guiding arms 22. Each buckle 23 has a pair of locking portions 230 bending vertically from an upper and a lower edges thereof, respectively. Each locking portion 230 has a pair of locking holes 2300 engaging with a corresponding pair of ribs 2220 defined on the front portion 222 of the guiding arm 22. The buckle 23 further has a locating sheet 233 extending laterally from one side thereof and locating beside the front portion 262*a* of the locating slot 262.

The ejection mechanism 3 comprises a metallic lever 31, a coil spring 32 and a push button 33. The lever 31, which is formed by stamping a metallic plate, is assembled on the cross bar 20 of the header 2. The lever 31 comprises an ejection hook 310 defined at one end thereof, a locating hole 312 defined at a middle thereof for receiving the shaft 202 of the cross bar 20 therein, and a bending portion 314 defined at the other end thereof for movably buckling on the sliding recess 224 and sliding along the recess 224. The bending portion 314 further has a lateral connecting flange 3140 extending outwardly.

The push button 33 is movably assembled to one of the guiding arms 22, which includes a front portion 330 and a rear portion 332 connected with the front portion 330. The front portion 330 defines a locating slot 3302 at a free end thereof for receiving the connecting flange 3140 of the lever 31 therein. The rear portion 332 has a T-shape pushing block 3320 defining laterally at one inner side thereof for engaging with the shallower front portion 226*b* of the locating slot 226. The coil spring 32 comprises a plurality of turns having same diameters, which can be inserted into the locating slot 226.

In assembly, the lever 31 is mounted on the mating face 20*b* of the cross bar 20 with the locating hole 312 of the lever 31 receiving the shaft 202 of the cross bar 20 therein, and the bending portion 314 of the lever 31 is buckled on the sliding recess 224 of the guiding arm 22. The coil spring 32 is inserted into the locating slot 226 from the shallower front portion 226*b* and positioned in the deep rear portion 226*a* by the sidestep 227. Then, the push button 33 is assembled to the guiding arm 22 with the T-shape pushing block 3320 being inserted into the shallower front portion 226*b* of the locating slot 226 and positioned by both the T-shape front portion 226*b* and the locating 233 of the buckle 23, and the locating slot 3302 of the push button 33 is connected with the connecting flange 3140 of the lever 31.

When a card (not shown) is inserted, an edge of the card abuts against the ejection hook 310 to push the lever 31 backward till the card is electrically connected with the signal contacts 21. When the user wants to withdraw the inserted card and inwardly pushes the push button 33, the T-shape pushing block 3320 compresses the coil spring 32 received in the locating slot 226 and drives the lever 31 to rotate around the shaft 202 of the cross bar 20 thereby moving the ejection hook 310 to eject the inserted card.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An ejection mechanism for a compact flash card connector, comprising:

an insulative header having a cross bar and a pair of guiding arms extending from opposite ends of the cross bar, at least one of the guiding arms defining a receiving slot at an outer side thereof, the receiving slot comprising a front portion and a rear portion a lever pivotally mounted on the cross bar, the lever having an ejection portion at one end thereof;

a spring in the rear portion of the receiving slot;

a push button comprising a front portion connected with the lever and a rear portion, the rear portion having a locating block defined at one inner side thereof and movably retained in the front portion of the receiving slot, the locating block being rearwardly urged by the spring and being forwardly movable to actuate the lever;

wherein the front portion of the receiving slot has a T-shaped configuration, the rear portion being connected with the front portion and forming a sidestep between the front and rear portions, the spring being positioned by the sidestep;

wherein the front portion of the push button has a locating slot and the lever has a connecting flange at one end thereof engaged with the locating slot, the locating block of the rear portion of the push button presenting a corresponding T-shaped configuration for being received in the T-shaped front portion of the receiving slot.

* * * * *